United States Patent [19]

Ohi

[11] Patent Number: 4,681,170

[45] Date of Patent: Jul. 21, 1987

[54] ROCK DRILLS FOR DRILLING CONTINUOUSLY ARRAYED BORES

[75] Inventor: Toshio Ohi, Takasaki, Japan

[73] Assignees: Furukawa Co., Ltd., Tokyo; Okumura Corporation, Osaka, both of Japan

[21] Appl. No.: 762,528

[22] Filed: Aug. 5, 1985

[51] Int. Cl.[4] ..... E21C 3/00

[52] U.S. Cl. ..... 173/50; 173/57; 173/80

[58] Field of Search ..... 173/50, 51, 57, 105, 173/80; 175/108

[56] References Cited

U.S. PATENT DOCUMENTS

| | | | |
|---|---|---|---|
| 337,968 | 3/1886 | Manning | 175/108 X |
| 1,377,575 | 5/1921 | Greve | 173/57 |
| 1,696,576 | 12/1928 | Jones | 173/50 X |
| 4,006,783 | 2/1977 | Granholm | 173/105 X |
| 4,271,916 | 6/1981 | Williams | 173/57 X |

FOREIGN PATENT DOCUMENTS

| | | | |
|---|---|---|---|
| 116898 | 1/1981 | Japan . | |
| 717309 | 2/1980 | U.S.S.R. | 173/51 |
| 992736 | 1/1983 | U.S.S.R. | 175/108 |

*Primary Examiner*—Robert P. Olszewski

*Attorney, Agent, or Firm*—Basile Weintraub Hanlon

[57] ABSTRACT

A rock drill for drilling a plurality of arrayed continuous bores includes a plurality of rods positioned so as to be able to drill several arrayed continuous bores, a rotating member to give rotation to the rods and a single percussion member which imparts percussive force to the plurality of rods. The plurality of rods may be passed through integrally formed rod guides by connecting several cylindrical members juxtaposed in parallel. The guide rod may optionally include, at its rear end, a swivel which also acts as a rod holder.

2 Claims, 7 Drawing Figures

ROCK DRILLS FOR DRILLING CONTINUOUSLY ARRAYED BORES

BACKGROUND OF THE INVENTION

1. Field of the Invention

This invention relates to a rock drill or machine drill for drilling a plurality of bores of slit-like shape in continuously arrayed bores and, more particularly, to a rock drill which comprises a plurality of drilling rods disposed in such a manner that they can drill several arrayed bores by a percussive force which is imparted by a single percussive means such that it is able to reduce the energy consumed as well as to miniaturize the size of the percussive means.

2. Description of the Prior Art

In digging works, such as tunnelling or the like, and where there are one or more dwellings, previously built facilities or buildings adjacent to the construction site, it is usual that construction relying on blasting is bound by regulations on the time of blasting, the number of the times of blasting, the amount of explosive to be used in one blasting operation in view of the environmental problems due to vibrations and noise caused by blasting, and for the sake of precaution to avoid the possible scattering of stones and crushed rocks. Accordingly, it is inevitable that such blasting take place at several times rather than in a single blasting operation.

Moreover, at a construction site where use of explosive is prohibited, digging work, relying on a rock breaker or breakers is sometimes utilized. However, such digging work is inefficient in digging hard rock stratum.

Rock drilling by means of arrayed bore drilling can be effectively applied to these crushing operations. Even where there is no particular regulation for blasting, drilling of such arrayed bores along the outer periphery of the cross section to be cut followed by blasting utilizing the arrayed bores as a free surface or surfaces, will provide beneficial effects with less amount of explosive, together with better surface finish, as compared with the angle cutting method, by virtue of the fact that it is possible to make use of the tensile breakage of the rock under drilling.

There has been proposed one type of rock drill for drilling arrayed bores for use in these conditions wherein a plurality of rock drills are disposed along a straight line and each rod of the rock drills carries bits capable of drilling arrayed bores or one in which a plurality of rock drills are disposed in an arrangement shifted from one after another in a lengthwise direction (refer to Japanese Laid-Open Patent Publication No. 57-116893).

In the former case, however, since the spacing between the centers of adjacent bits becomes larger than the transverse width of the rock drill to be used, the diameter of the bit has to be made larger so as to form arrayed bores. This naturally requires larger drilling energy.

In the latter case, since the rock drills are shifted one after another in a lengthwise direction, the spacing between the centers of two adjacent bits cannot be made smaller than half of the sum of the transverse width of the rock drill and the rod diameter. Accordingly, it is impossible to greatly reduce the drilling energy of the device, although the spacing has been made slightly smaller than that of the former case. In addition, since both of the rock drills of the prior art mentioned above are of the type which includes a plurality of rock drills, the percussion means become larger in size together with an increase in the number of pipings from the power source which impairs the operability of the device and brings about troublesome problems in maintenance.

This invention aims to obviate such problems encountered in rock drills for drilling arrayed and continued bores as mentioned above. Another object of the invention is to provide a rock drill which can remarkably reduce the required drilling energy.

A further object of the invention is to provide a rock drill having a percussion member smaller in size than previously utilized and which is better in operability. A still further object of the present invention is to provide a rock drill which can carry out non-explosive rock crushing work with high efficiency so as to prevent any environmental nuisance, such as vibrations and noise.

SUMMARY OF THE INVENTION

According to the present invention, a rock drill includes a plurality of rods arranged for boring a plurality of continuously arrayed bores, a rotation member for imparting rotation to the rods and a single percussion member for imparting percussion to the plurality of rods.

The plurality of rods may be constructed either by being passed through an integrally formed rod guide or a plurality of cylindrical members in parallel. Alternatively, the rod guide can be made to have a plurality of swivels, each of which also acts as a rod holder.

Since the rock drill for drilling arrayed bores according to the present invention is constructed, as explained above, so that the plurality of drill rods can be imparted with a percussive force by a single percussive member, the rods can be disposed closely adjacent one after another; thereby significantly reducing the drilling energy of the device.

Also, as the percussion member can be made smaller in size and with a smaller number of pipings, the device can be improved in operability together with easier maintenance.

By virtue of the merits of the present invention which enables non-explosive rock crushing in a highly efficient manner, various environmental problems in digging operations can be avoided. In addition, since the present invention can obviate curving of the bore during digging operations and is able to simplify the ejection of sludge, efficiency of the digging operation can also be increased.

BRIEF DESCRIPTION OF THE DRAWINGS

FIGS. 1–7 show preferred embodiments of the present invention, in which:

FIG. 1 is a plan view of the rock drill for drilling arrayed bores;

FIG. 2 is a side elevational view of the rock drill shown in FIG. 1;

FIG. 3 is a plan view showing a portion of the rods in an enlarged scale;

FIG. 4 is a cross sectional side view of FIG. 3;

FIG. 5 is a transverse cross sectional view showing the rods in arrayed bores under digging conditions;

FIG. 6 is partly fragmented sectional view of a rotating member; and

FIG. 7 is a cross sectional side view showing a part of a percussive member.

DESCRIPTION OF THE PREFERRED EMBODIMENTS

Figure 1:
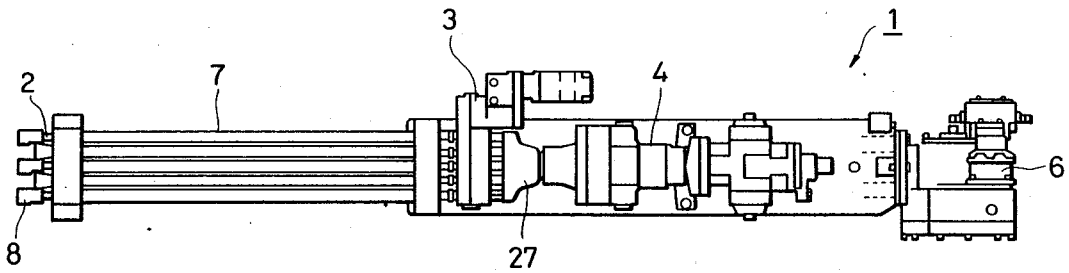
Figure 2:
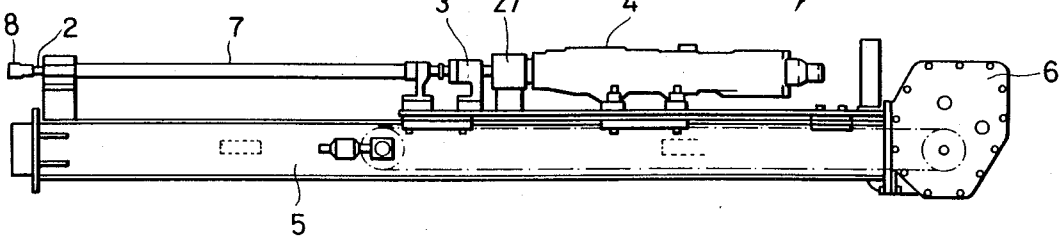
Figure 3:
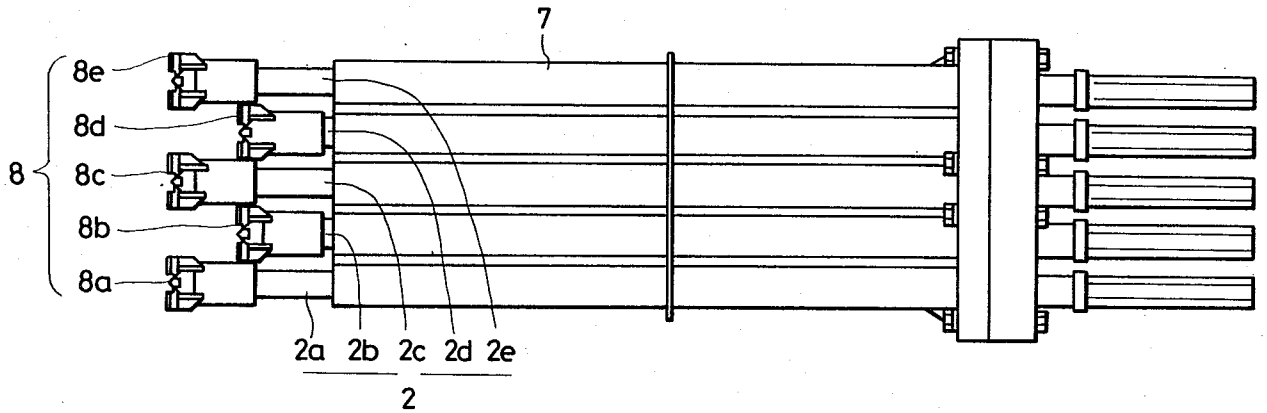
Figure 4:
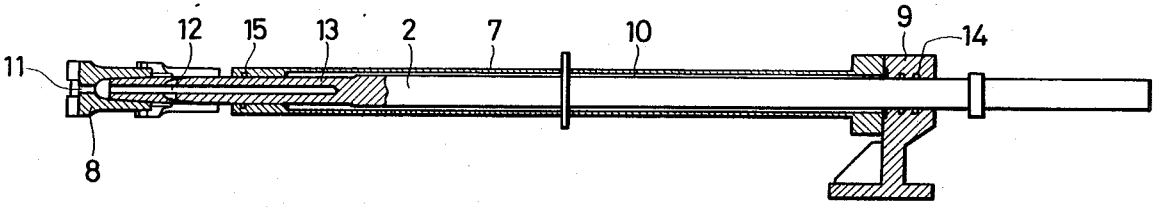
Figure 5:
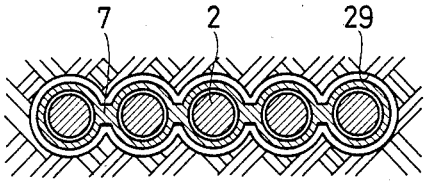
Figure 6:
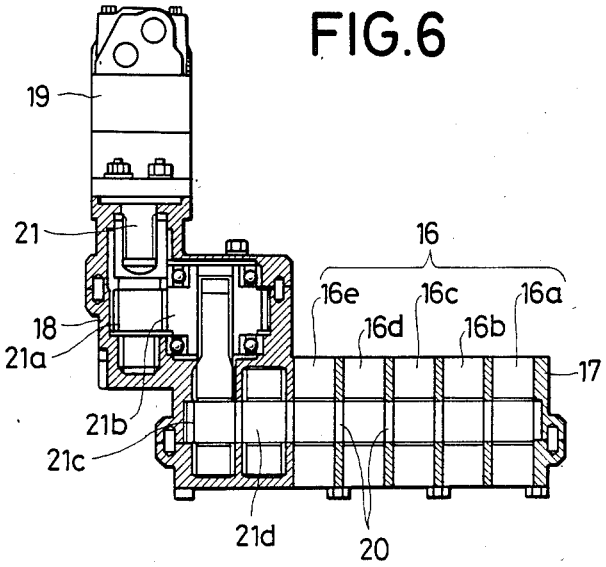

Explanation will now be made of the preferred embodiments of the present invention by referring to the accompanying FIGS. 1–7 of the drawings.

The rock drill 1 for drilling arrayed bores comprises a plurality of rods 2, a rotation member 3, and a percussion member 4, which are mounted on a guide shell 5 and a feeding means 6 for advancing or retracting the drill 1.

Each of the rods 2 is passed through a rod guide 7 formed as an integral member by combining a plurality of cylindrical tubular members. In this embodiment, five rods (2*a*, 2*b*, 2*c*, 2*d* and 2*e*) are used. However, the number of rods 2 can be varied as desired. Attached at the front end of each rod is a respective bit 8 (8*a*, 8*b*, 8*c*, 8*d* and 8*e*). By virtue of such construction, adjacent bits are located at different positions shifted from each other, to some extent, in a lengthwise direction. By selecting diameter the of each bit 8 to be slightly larger than the spacing between the center of two adjacent rods 2, the rock drill of the present invention has been rendered capable of boring arrayed continuous bores.

The rod guide 7 acts to hold and guide all of the rods 2 along their entire length. At the rear end of the rods 2 there are provided swivels 9 for ejecting sludge yielded during the drilling operation. The swivels 9 also play a role in preventing forward escapement of each rods during the drilling operation.

The inner face of the rod guide 7 and the outer peripheral face of the rod 2 are spaced apart to provide a clearance therebetween which forms a fluid passage 10 for flushing fluid therethrough, while only at their front ends are they closely sealed. At the center of both the bit 8 and the rod 2, flushing holes 11 and 12 are provided, both of which are connected via communicating passages 13 to the fluid passage 10 so that the flushing fluid can be introduced therethrough.

The rotating means 3 is composed of chucks 16 (16*a*, 16*b*, 16*c*, 16*d* and 16*e*) which each rear end of the rod 2 is inserted into, chuck holders 17 each of which rotatably holds the chuck 16, a gear box 18 and an orbit motor 19. Each rear end of rods is hexagonal in cross section. On the outer surface of the chuck 16 a gear 20 is formed. Rotation of the output shaft 21 of the orbit motor 19 is transmitted through a set of gears 21*a*, 21*b*, 21*c*, and 21*d* to chuck 16 so as to make rods 2 rotate.

Figure 7:
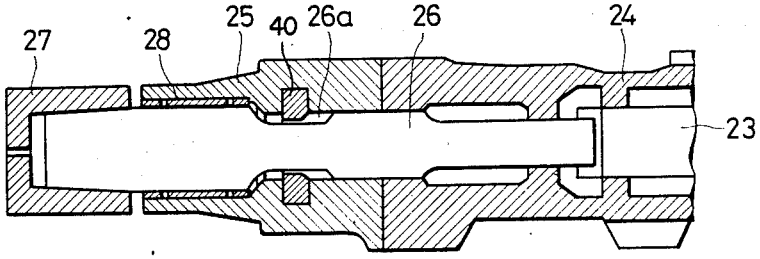

The percussive member 4 comprises a front cap 25, FIG. 7, at the front portion of a cylinder 24 which receives therein a free piston 23 and holds a shank rod 26, to the front end of which a tappet 27 is capped.

The free piston 23, similar to the pistons of prior art rock drills, is imparted with repeated reciprocal movement, by fluid under pressure, alternatively supplied to the rear chamber and the front chamber of the cylinder 24, thereby applying percussion to the rear end face of the shank rod 26.

The shank rod 26 is slidably received within the front cap 25 through a plain bearing 28 and the forward escapement of the shank rod 26 is prevented by a half washer 40 disposed within the front cap 25 and engagable with the reduced diameter portion 26*a* of the shank rod 26.

The tappet 27 has a width large enough to impact all rear end portions of the plurality of rods 2*a*, 2*b*, 2*c*, 2*d*, 2*e*, thereby the impact given to the shank rod 26 is simultaneously transmitted to all of the rods 2*a*, 2*b*, 2*c*, 2*d* and 2*e*.

The drill rods for drilling arrayed continuous bores, according to the present invention are used by attaching the guide shell 5 to the tip end of the boom attached to known working vehicles and capable of performing tilting and rotational movement. It is also possible to utilize an increased number of rods and or percussion members.

In performing drilling operations, the rock drill 1 is positioned as desired for the drilling of the cutting face, then rotation and percussion is transmitted to the rods 2 and the drilling machine is advanced by the feed means 6. During this operation, the rods 2 are held and guided along their entire length by the integrally formed rod guide 7, and therefore, there arises no possibility of curving of the bore during the drilling operation.

Flushing fluid for washing away the sludge yield during the drilling operation is charged through the swivel 9, and passes through the passage 10, the flushing holes 12 and 11, and further between the rod guide 7 and the inner wall of the continued bores 29, in that order. Since the gap between the rod guide 7 and the inner wall of the continued bores 29 is very small, the flow speed of the fluid is increased so as to enhance ejection of the sludge.

What is claimed is:

1. A rock drill for drilling a plurality of arrayed continuous bores comprising:

a plurality of rods positioned for drilling a plurality of arrayed continuous bores;

a rotating means for imparting rotation to said rods;

a single percussion member for imparting percussive force to said plurality of rods; and a rod guide which the plurality of rods are passed through and held within including a plurality of cylindrical tubular members integrally combined, each one thereof corresponding to one of the plurality of rods, wherein each of said plurality of rods is passed through its corresponding tubular member so as to hold and guide the plurality of rods for substantially their entire length and to provide a fluid passage for flushing fluid formed between an outer surface of each of the plurality of rod members and an inner surface of the corresponding tubular member.

2. The rock drill for drilling a plurality of arrayed continuous bores as claimed in claim 1, wherein said rod guide comprises a swivel which also functions as a rod holder.

* * * * *